US011407001B2

(12) United States Patent
Sasa et al.

(10) Patent No.: US 11,407,001 B2
(45) Date of Patent: Aug. 9, 2022

(54) CURTAIN APPLICATOR AND METHOD FOR APPLYING AN APPLICATION MEDIUM

(71) Applicant: VOITH PATENT GMBH, Heidenheim (DE)

(72) Inventors: Tadashi Sasa, Tokyo (JP); Akio Hirano, Chiba (JP); Hiroyuki Kohno, Fukushima (JP); Christoph Henninger, Heidenheim (DE); Uwe Froehlich, Neu-Ulm (DE); Toshihiro Katano, Tokyo (JP)

(73) Assignee: Voith Patent GmbH, Heidenheim (DE)

( * ) Notice: Subject to any disclaimer, the term of this patent is extended or adjusted under 35 U.S.C. 154(b) by 105 days.

(21) Appl. No.: 16/480,392

(22) PCT Filed: Jan. 11, 2018

(86) PCT No.: PCT/EP2018/050622
§ 371 (c)(1),
(2) Date: Jul. 24, 2019

(87) PCT Pub. No.: WO2018/137932
PCT Pub. Date: Aug. 2, 2018

(65) Prior Publication Data

US 2020/0038901 A1 Feb. 6, 2020

(30) Foreign Application Priority Data

Jan. 25, 2017 (DE) ..... 102017101373.3

(51) Int. Cl.
*B05C 5/00* (2006.01)
*D21H 23/48* (2006.01)
(Continued)

(52) U.S. Cl.
CPC ..... *B05C 5/005* (2013.01); *B05C 5/0254* (2013.01); *B05C 11/06* (2013.01); *B05D 1/30* (2013.01); *D21H 23/48* (2013.01)

(58) Field of Classification Search
CPC ..... B05C 5/005; B05C 5/0254; B05C 11/06; D21H 23/48; B05B 1/28; Y10S 118/04; B05D 1/30
(Continued)

(56) References Cited

U.S. PATENT DOCUMENTS 4,128,667 A * 12/1978 Timson ..... B05D 1/30 427/348
5,773,093 A * 6/1998 Mitani ..... G11B 5/842 427/420
(Continued)

FOREIGN PATENT DOCUMENTS

CN 103321083 * 9/2013
DE 10242012 A1 3/2004
(Continued)

OTHER PUBLICATIONS

English Translation of CN103321083, Congding et al, published Sep. 25, 2013 (Year: 2013).*
(Continued)

*Primary Examiner* — Laura Edwards
(74) *Attorney, Agent, or Firm* — Laurence A. Greenberg; Werner H. Sterner; Ralph E. Locher

(57) ABSTRACT

A curtain applicator for applying a liquid or pasty application medium to at least one surface of a running material web, in particular a fibrous web. The curtain applicator has an applicator nozzle, in particular a slotted nozzle, which under the effect of gravity, and optionally with further forces, is suitable for dispensing a single-tier or multi-tier curtain onto the surface of the material web. The curtain applicator further has a wiping device which is suitable for keeping entrained air carried by the material web away from the curtain. Moreover, there is provided at least one further blocking device which is suitable for keeping air movements of the ambient air away from the curtain.

17 Claims, 2 Drawing Sheets

(51) Int. Cl.

| | |
|---|---|
| ***B05C 5/02*** | (2006.01) |
| ***B05D 1/30*** | (2006.01) |
| ***B05C 11/06*** | (2006.01) |

(58) Field of Classification Search
USPC ..... 118/300, 411, 412; 427/420
See application file for complete search history.

(56) References Cited

U.S. PATENT DOCUMENTS

| | | | | |
|---|---|---|---|---|
| 6,468,592 | B1 * | 10/2002 | Becker | D21H 23/48 118/325 |
| 2004/0107899 | A1 * | 6/2004 | Bernert | D21H 23/30 118/300 |
| 2004/0166244 | A1 | 8/2004 | Ueberschar et al. | |

FOREIGN PATENT DOCUMENTS

| | | | | |
|---|---|---|---|---|
| DE | 102008040405 | A1 * | 1/2010 | D21H 23/48 |
| DE | 102008040419 | A1 * | 1/2010 | D21H 23/48 |
| DE | 102008040419 | A1 | 1/2010 | |
| DE | 202008040405 | A1 | 1/2010 | |
| EP | 1208917 | A2 | 5/2002 | |
| EP | 1525924 | A2 | 4/2005 | |
| EP | 1538263 | A1 | 6/2005 | |
| EP | 1676957 | A2 * | 7/2006 | |
| JP | 2002-102765 | * | 4/2002 | |

OTHER PUBLICATIONS

English Translation of EP1676957-A2 (Description Only), published Jul. 5, 2006, Mendez Gallon et al. (Year: 2006).*
Pulkrabek,W.W., et al. "Single-Pass Curtain Coating". University of Wisconsin-Platteville Mechanical Engineering Department.

* cited by examiner

CURTAIN APPLICATOR AND METHOD FOR APPLYING AN APPLICATION MEDIUM

BACKGROUND OF THE INVENTION

Field of the Invention

The invention relates to a curtain applicator for applying a liquid or pasty application medium to at least one surface of a running material web, in particular a fibrous web. The curtain applicator includes an applicator nozzle, in particular a slotted nozzle, which under the effect of gravity and optionally the effect of further forces is suitable for dispensing a single-tier or multi-tier curtain onto the surface of the material web, and furthermore a wiping device which is suitable for keeping entrained air carried by the material web away from the curtain. The invention also relates to a method for coating a running material web, in particular a fibrous web.

In the production of fibrous webs such as paper webs or cardboard webs, a coating, so-called coat, is often applied to one or both sides of the material web in order for the surface properties to be improved. To this end, the coating by means of a curtain applicator has established itself in the past years. In said coating, a thin curtain of a liquid or pasty medium from a nozzle is deposited onto the material web under the effect of gravity. In order for an ideally uniform application of the coating medium to be guaranteed, any disturbance of the thin curtain has to be largely avoided.

Such a curtain is particularly susceptible to air flows. The curtain is particularly sensitive especially in the case of applications in which a large curtain height is required or desired, or at low flow rates of coating paint.

Air flows are created in many locations in the environment of the paper machine. For example, entrained air which can disturb the curtain is thus carried by the material web per se. In order for such air barrier layers to be removed, various devices for the removal of air barrier layers are known from the prior art. To this end, DE 10 2008 040 419 as well as DE 10 2008 040 405 are to be set forth in an exemplary manner.

However, a multiplicity of air flows which are not induced on account of the moving material web also arise. The causes of such flows can be moving parts of the machine or else the shed ventilation or the movements of the operating personnel. In order for air flows of this type to be kept away from the curtain, the curtain applicators in the past have been encapsulated as is shown in EP 1 538 263, for example. However, such an encapsulation has a few disadvantages. On the one hand, the encapsulation has to be embodied so as to be relatively large so that the operating personnel can access the applicator for checking and servicing. Such a large encapsulation not only requires a correspondingly large space in the machine shed but is also associated with significant costs. It is furthermore disadvantageous that the operating personnel has to enter the encapsulation for servicing and checking. There is the risk here that air flows within the encapsulation which can disturb the curtain are generated on account of the movements of the operating personnel.

SUMMARY OF THE INVENTION

It is thus an object of the present invention to propose a curtain applicator in which the curtain even in the case of comparatively large curtain height, or of a small application quantity of application medium, respectively, remains largely uncompromised by air flows.

A further object of the invention is to enable servicing and checking of the curtain applicator such that the curtain is not at all influenced by the movements of the operating personnel or is influenced only to a very minor extent.

The object is completely achieved by a curtain applicator according to the claims, as well as by a method for coating a running material web according to the method claims.

A curtain applicator is provided herein for applying a liquid or pasty application medium onto at least one surface of a running material web, in particular a fibrous web.

The curtain applicator comprises an applicator nozzle, in particular a slotted nozzle, which under the effect of gravity and optionally the effect of further forces is suitable for dispensing a single-tier or multi-tier curtain onto the surface of the material web. The curtain applicator furthermore comprises a wiping device which is suitable for keeping entrained air carried by the material web away from the curtain. According to the invention, at least one further blocking device which is suitable for keeping air movements of the ambient air away from the curtain is provided.

The further blocking device according to the invention guarantees that the curtain remains largely uncompromised by air flows even in the case of comparatively large curtain height.

In terms of the embodiment as well as the disposal of the further blocking device there are a multiplicity of possibilities, as will yet be explained later, such that the curtain applicator can be adapted to the circumstances of the installation situation, to the running profile of the material web, etc. such that servicing and checking of the curtain applicator is readily possible without the curtain being significantly influenced by the movements of the operating personnel.

On account of the invention it is in particular intended to be possible for the otherwise commonplace complete encapsulation of the curtain applicator conjointly with part of the running material web to be dispensed with. This significantly simplifies the construction and the installation of the curtain applicator a coating line, and moreover significantly reduces the associated costs.

In general, all commonplace nozzles that are usual in the field of curtain application can be used as the applicator nozzle. The probably most frequently used types are the so-called "slot dies" in which the application medium exits a slot that is typically as wide as the machine and can drop freely onto the material web, on the one hand. On the other hand, so-called "slide dies" are often also used. In the case of this type of applicator nozzle, the application medium first runs for a certain distance across an incline before said application medium free-falls onto the material web.

The applicator nozzles in the context of this invention can also be suitable for applying single-tier or multi-tier curtains.

The invention is however not limited to said types of nozzles.

Advantageous embodiments of the invention will be described in the dependent claims.

It can thus be provided, for example, that the spacing of the opening of the applicator nozzle from the material web is at least 100 mm, preferably at least 200 mm, particularly preferably at least 300 mm. in the case of an embodiment of this type, the dropping height of the curtain when applying the curtain is comparatively very large. The curtain here is also very susceptible to disturbances, in particular to air movements of the ambient air. The advantageous effect of the invention is particularly great in the case of such an embodiment.

It can furthermore be advantageously provided that the at least one further blocking device in the running direction of the material web is disposed ahead of the applicator nozzle.

In one particularly advantageous embodiment it can be provided that the spacing of the further blocking device from the applicator nozzle is less than 150 cm, in particular less than 100 cm, particularly preferably between 80 cm and 50 cm. For example, the risk of air movements which can have a disturbing effect on the curtain being generated in the space between the further blocking unit and the curtain applicator can be reduced on account thereof. On account of such a close disposal it can in particular be avoided that operating personnel can be present between the further blocking device and the curtain applicator during the operation.

In one preferred embodiment it can be provided, for example, that the at least one further blocking device comprises a plate which is fastened to, or in the immediate proximity of, the applicator nozzle and extends so as to be substantially parallel to the curtain. When viewed in the running direction of the material web, such a plate can be attached ahead of or behind the curtain. In one further, particularly preferred, embodiment a further plate which is fastened to, or in the immediate proximity of, the applicator nozzle can also be provided. In this case, the one plate is often provided ahead of the curtain, and the further plate is provided behind the curtain.

It can in particular be provided that one or both of said plates is/are provided at a spacing from the curtain of less than 100 mm, preferably less than 50 mm. An extremely compact construction mode of the curtain applicator is possible in this embodiment of the invention.

In one further advantageous embodiment of the invention the further blocking device can comprise means, in particular one or a plurality of air nozzles, for generating an air shield.

It can in particular also be provided that the flow direction of the air of the air shield has a component which points away from the applicator nozzle and/or has a component which points away from the material web.

The blocking effect of the further blocking device in these embodiments is implemented in that an airflow is generated in a targeted manner, said air flow however being directed such that said air flow does not disturb the curtain. The placing of such a blocking device will often not be possible quite so close to the curtain as in the case of the embodiment as a plate, so as to avoid disturbances of the curtain by the air shield per se. The airflow of the air shield herein should be dimensioned so as to be so strong that the air movements of the ambient air do not penetrate the air shield, said air movements being generated by the movement of the operating personnel, for example.

In order for a largest possible blocking effect to be fulfilled, the air shield will often extend at least across the width of the material web, or the width of the curtain, respectively, or even extend somewhat therebeyond.

Since the air quantities and air velocities required can vary heavily depending on the installation and operation conditions, means for the open-loop or closed-loop controlling, respectively, of the air quantity and/or the air velocity can be provided in particularly advantageous embodiments. The operator thus has the possibility of setting the air shield in an optimum manner.

A further great advantage of said air shield lies in that the operating personnel can simply switch off the air shield for repair or maintenance jobs, respectively, or else can simply reach through the air shield. A potentially complex disassembly of a fixedly installed rigid device can thus be dispensed with. For example, a suitable collection vessel or specimen carrier can thus be guided through the air shield to the curtain for retrieving specimens of the application medium from the curtain. To this end, the application process does not have to be interrupted nor does the air shield have to be switched off.

In one further advantageous embodiment it can be provided that the at least one further blocking device comprises at least two air nozzles for generating in each case one air shield, wherein one of the air nozzles is provided ahead of the curtain and one further air nozzle is provided behind the curtain. (When viewed in the running direction of the material web). The flow direction of the air of the at least two air shields herein has in each case a component which points toward the material web.

The two air nozzles herein are advantageously attached close to the curtain. It can in particular be provided that one or both of said air shields is/are provided at a spacing from the curtain of less than 100 mm, preferably less than 50 mm. To this end, the nozzles can be fastened directly to the applicator nozzle, for example. An extremely compact construction mode of the curtain applicator is possible in this embodiment of the invention.

It is particularly advantageous for the two air shields, or the air nozzles, respectively, to be provided at an identical spacing from the curtain. Nozzles of identical construction can in particular be used.

It is furthermore advantageous for the two air shields to be symmetrical, this means that in particular the direction and/or the air velocity and/or the air quantity of said air shields are/is identical. It can thus be prevented, for example, that the curtain is disturbed by the air shield per se even at a minor spacing of the air nozzles from the curtain. Advantageous air velocities for such an embodiment can be between 5 m/s and 50 m/s, in particular between 10 m/s and 15 m/s.

In terms of the method, the object is achieved by a method for applying a liquid or pasty application medium to at least one surface of a running material web by means of a curtain applicator, wherein under the effect of gravity and optionally under the effect of further forces a single-tier a multi-tier curtain is dispensed from an applicator nozzle onto the surface of the material web, characterized in that entrained air carried by the running material web is kept away from the curtain by means of a wiping device, and additionally air flows of the ambient air are kept away from the curtain by means of a further blocking device.

Advantageous embodiments of the method are stated in the dependent claims.

All blocking devices described above are inter alia suitable for the further blocking device provided in the method. Applicators according to an aspect of the invention are particularly suitable as the applicator.

One advantageous embodiment of the method is characterized in that the application medium is applied by the applicator nozzle at a flow rate of less than 10 l/min*m, in particular of less than 6 l/min*m, particular preferably between 2 l/min*m and 5 l/min*m. On account thereof, a comparatively thin curtain which can be influenced in a particularly easy manner by air movements of the ambient air is generated. The further blocking device provided according to the invention is particularly advantageous here. In particular also when the drop height of the curtain is more than 100 mm, more than 200 mm, or else 300 mm and more.

In one further advantageous embodiment of the method it can be provided that the material web is moved at a speed between 100 m/min and 800 m/min, in particular between 200 m/min and 600 m/min. In order for minor application quantities per unit of area to also be able to be implemented at said speeds, the composition and/or the thickness of the curtain have/has be adapted in a corresponding manner, which in turn also renders the curtain more susceptible to ambient air.

In terms of the importance of the flow rate, reference is to be made to table 1 hereunder. In an exemplary manner, the required flow rates are stated here as a function of the production rate and the desired coat weight for a coating paint as the application medium having a typical solids content of 63%.

TABLE 1

| Flow rates in l/min/m | | | | |
|---|---|---|---|---|
| | Coat weight | | | |
| Production rate | 8 g/m$^2$ | 10 g/m$^2$ | 12 g/m$^2$ | 14 g/m$^2$ |
| 200 m/min | 1.7 | 2.1 | 2.5 | 3.0 |
| 300 m/min | 2.5 | 3.2 | 3.8 | 4.4 |
| 400 m/min | 3.4 | 4.2 | 5.1 | 5.9 |
| 500 m/min | 4.2 | 5.3 | 6.3 | 7.4 |
| 600 m/min | 5.1 | 6.3 | 7.6 | 8.9 |

It can be clearly seen in table 1 that it is very important in a wide range of applications to be able to implement an application of low flow rates in a stable manner. The invention is very advantageous inter alia for the embodiments shown in table 1, in particular, but not exclusively in combination with a height of the curtain of 100 mm or more.

The coat weights between 8 g/m$^2$ and 14 g/m$^2$ shown here are quite commonplace. However, coat weights of up to 20 g/m$^2$ or more can also be implemented by the method according to the invention, or the device according to the invention, respectively.

The application medium can be, for example, a coating paint for coating paper or other fibrous webs.

The application medium usually contains a specific proportion of solids. For example, in the case of coating paints said solids herein can be $CaCO_3$, kaolin, and/or $TiO_2$; other solids are also used, however. The solids content of the application medium is between 55% and 72% in one particularly advantageous embodiment.

The Brookfield viscosity (measured at 100 rpm) of the application medium can advantageously be between 100 mPas and 800 mPas, in particular between 300 mPas and 600 mPas.

In one particularly advantageous embodiment of the method, the further blocking device can be implemented by an air shield.

Depending on the intended use, it can also be provided herein that the air used for the air shield is conditioned. The conditioning can comprise filtering and/or dehumidifying and/or heating, for example.

In the case of an air shield it can furthermore be provided that the velocity of the air of the air shield is between 15 m/s and 60 m/s.

BRIEF DESCRIPTION OF THE SEVERAL VIEWS OF THE DRAWING

The invention will be explained in more detail hereunder by means of schematic, not-to-scale figures.

DESCRIPTION OF THE INVENTION

Figure 1:
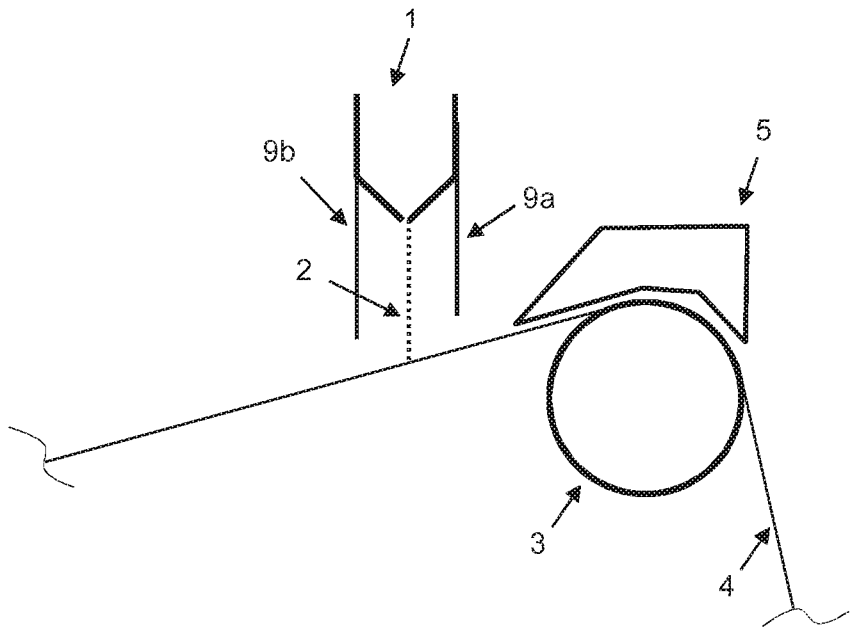
FIG. 1 shows a curtain applicator according to one aspect of the invention.
Figure 2:
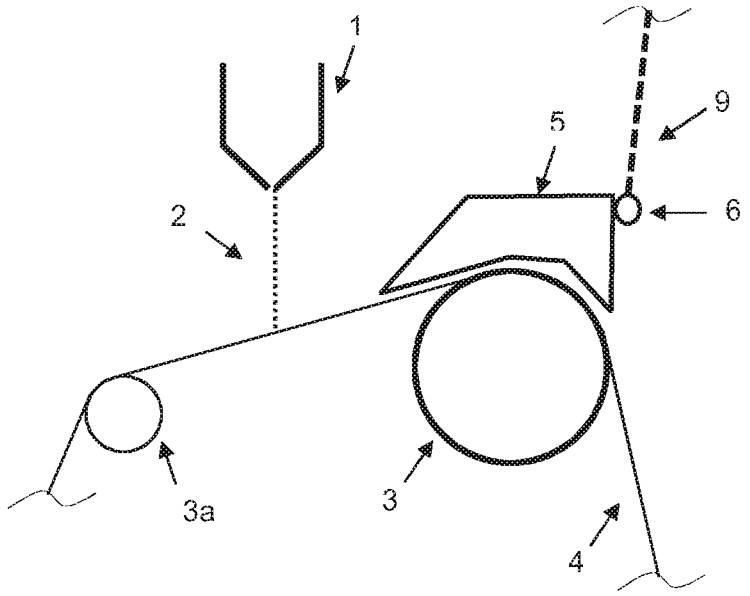
FIGS. 2 and 2*b* show in each case a curtain applicator according to a further aspect of the invention.

The curtain applicator shown in FIG. 1 comprises an applicator nozzle 1 from which a curtain 2 under the influence of gravity is applied to material web 4, for example a paper web or a cardboard web. The material web 4 herein is deflected by means of a deflection roller 3 such that the profile of said material web 4 runs so as to be largely horizontal below the curtain 2. The impact point of the curtain here, when viewed in the running direction of the material web 4, is somewhat behind the deflection roller 3. The entrained air carried by the material web 4 here is kept away from the curtain 2 by a wiping device 5. So-called air blades are known as suitable wiping devices 5 in the industry, for example. The wiping device 5 often reaches up to just before the impact point of the curtain. The at least one further blocking device 9, 9*a*, 9*b* according to the invention in FIG. 1 is implemented in the form of two plates 9*a* and 9*b*. The two plates 9*a*, 9*b* here are fastened directly to the applicator nozzle. While it is in principle also possible for the plates to be fastened otherwise, the fastening directly to the applicator nozzle 1 offers the advantage that the spacing of the plates 9*a*, 9*b* from the curtain 2 is extremely minor. Spacings of less than 100 mm, and even less than 50 mm, can be implemented here. This leads to a very compact construction mode. Moreover, the environment around the applicator nozzle, for example the deflection roller 3 or the wiping device 5, is freely accessible for maintenance works and similar during the operation without the curtain 2 being disturbed by a movement of the ambient air arising herein, A curtain applicator according to a further aspect of the invention is illustrated in FIG. 2. The at least one further blocking device 9, 9*a*, 9*b* herein is implemented by an air shield 9. The air for generating the air shield 9 exits an air nozzle 6 or a series of nozzles 6. The flow direction of the air, and thus the alignment of the air shield 9, herein can be perpendicularly upward or else also be slightly inclined toward said direction. Said inclination will advantageously be aligned away from the applicator nozzle 1 and thus also away from the curtain 2, so as to avoid the curtain 2 being influenced by the air shield 9. The air shield 9 can advantageously extend at least across the entire width of the curtain 2 in the machine cross direction.

In the case of the embodiment shown in FIG. 2, the air nozzle 6, or the series of nozzles 6, respectively, is fastened directly to the wiping device 5. This can be advantageous; however other possibilities for fastening can be possible and expedient, depending on the situation. The spacing of the air shield from the applicator nozzle can advantageously be less than 150 cm, in particular less than 100 cm, particularly preferably less than 50 cm. In the case of spacings of 80 cm and less, for example, it is possible for the operating personnel of the machine to be able to reach through the air shield 9 and to be able to perform jobs such as the retrieval of specimens on the nozzle or the curtain, respectively. As is shown in FIG. 2, a further deflection device such as, for example, a deflection roller 3*a* will usually also be provided behind the curtain 2. The spacing of said deflection device 3*a* from the curtain 3 can vary in different installations.

Figure 2B:
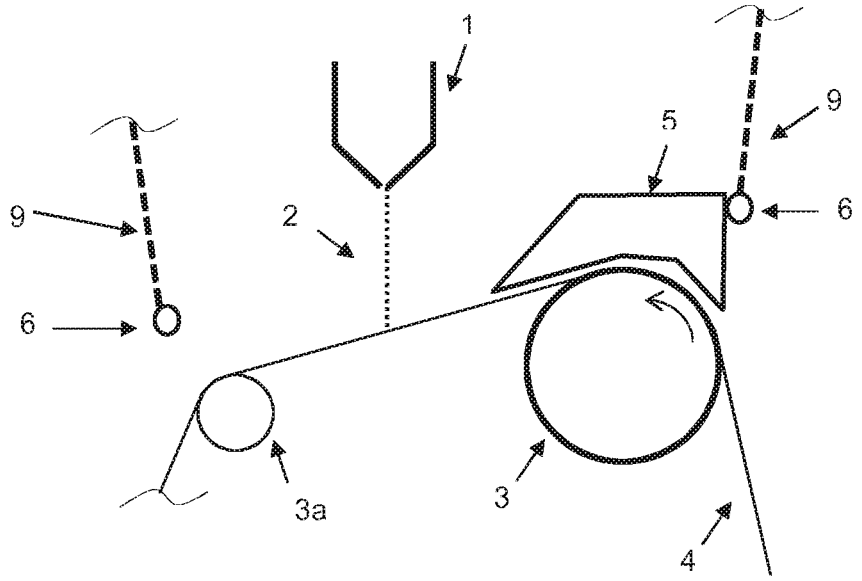

The applicator illustrated in FIG. 2*b* differs from that from FIG. 2 in that said applicator in FIG. 2*b* comprises a second blocking device 9 which is provided behind the curtain 2, or the applicator nozzle 1, respectively. This second blocking device 9 is likewise implemented by an air shield 9. The air for generating the air shield 9 exits an air nozzle 6 or a series of air nozzles 6. The flow direction of the air, and thus the alignment of the air shield 9, herein can be perpendicularly upward, as in the first blocking device, or else be slightly inclined toward said direction. Said inclination will advantageously be aligned away from the applicator nozzle 1 and thus also away from the curtain 2 so as to avoid the curtain 2 being influenced by the air shield 9. The air shield 9 can advantageously extend at least across the entire width of the curtain 2 in the machine cross direction. The same applies to the spacing of said second blocking device 9 from the curtain as to the first blocking device. Here too, spacings between 80 cm and 50 cm are very advantageous. However, larger or smaller spacings can also be chosen by virtue of the respective situation in terms of construction such as, for example, the disposal of the rollers 3*a* or the routing of the material web 4.

Figure 3:
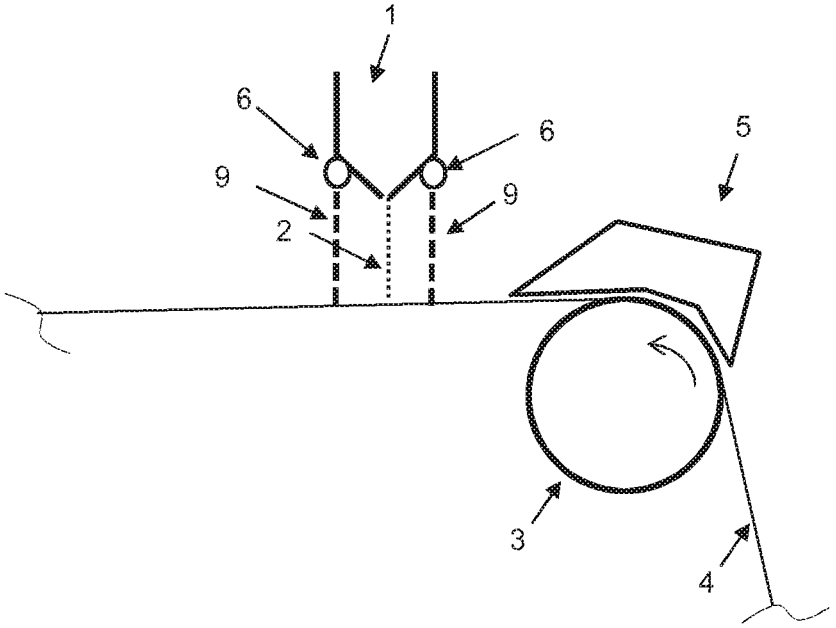
FIG. 3 shows a curtain applicator according to a further aspect of the invention.

An embodiment in which the at least one further blocking device comprises at least two air nozzles for generating in each case one air shield is shown in FIG. 3. Herein, one of the air nozzles is provided ahead of the curtain, and one further air nozzle is provided behind the curtain. (When viewed in the running direction of the material web). The flow direction of the air of the two air shields has in each case a component which points toward the material web.

The two air nozzles herein are advantageously attached close to the curtain. The spacing from the curtain can be less than 100 mm, preferably less than 50 mm. In the embodiment of FIG. 3, the nozzles are fastened directly to the applicator nozzle. An extremely compact construction mode of the curtain applicator is thus possible. Furthermore, the two air shields, or the air nozzles, respectively, are provided at an identical spacing from the curtain. Nozzles of identical construction can be used therefor.

Moreover, the two air shields are symmetrical which means that the direction and/or the air velocity and/or the air quantity thereof are/is in particular identical. On account thereof it can be prevented that the curtain is disturbed by the air shield per se even in the case of a minor spacing of the air nozzles from the curtain. Advantageous air velocities for such an embodiment can be between 5 m/s and 50 m/s, in particular between 10 m/s and 15 m/s.

While a curtain applicator which applies a single-tier curtain is illustrated in an exemplary manner in each of the figures, the invention is not limited thereto. The known applicator nozzles 1 can likewise be used for two-tier or multi-tier curtains 2 in a curtain applicator according to the invention. While the applicator nozzle 1 is in an exemplary manner illustrated in the schematic form of a so-called "slot die" in the figures, illustrated embodiments can in each case also be implemented using other types of nozzles, for example so-called "slot dies."

The invention claimed is:

1. A curtain applicator for applying a liquid or pasty application medium to a surface of a running material web, the curtain applicator comprising:

an applicator nozzle which under the effect of gravity is configured for dispensing a single-tier or multi-tier curtain onto the surface of the material web;

a wiping device disposed in a vicinity of the running material web upstream of a location at which the curtain dispensed by said applicator nozzle impinges on the running material web, said wiping device being configured for keeping entrained air carried by the running material web away from the curtain; and at least one blocking device that is structurally different from said wiping device and is configured for keeping air movements of ambient air away from the curtain, said at least one blocking device being disposed at a location in front of the curtain, behind the curtain, or in front of and behind the curtain in a running direction of the material web;

said at least one blocking device comprising one or a plurality of air nozzles for generating an air shield upstream of said wiping device and reaching upwardly beyond a height of said wiping device, with an upward flow direction of air in the air shield having a component that points away from the material web.

2. The curtain applicator according to claim 1, wherein said applicator nozzle is a slotted nozzle.

3. The curtain applicator according to claim 1, wherein a spacing distance between an opening of said applicator nozzle from the material web is at least 100 mm.

4. The curtain applicator according to claim 3, wherein the spacing distance between the opening of said applicator nozzle from the material web is at least 300 mm.

5. The curtain applicator according to claim 1, wherein a spacing distance of said blocking device from said applicator nozzle is less than 150 cm.

6. The curtain applicator according to claim 5, wherein the spacing distance of said blocking device from said applicator nozzle is between 80 cm and 50 cm.

7. The curtain applicator according to claim 1, wherein said at least one blocking device comprises a plate which is fastened to, or in an immediate proximity of, said applicator nozzle.

8. The curtain applicator according to claim 7, wherein said plate is a first plate and said blocking device comprises a second plate which is fastened to, or in the immediate proximity of, said applicator nozzle, wherein said first plate is attached ahead of the curtain in the running direction of the material web, and said second plate is attached behind the curtain in the running direction of the material web.

9. The curtain applicator according to claim 8, wherein a spacing distance of said first plate and/or of said second plate from the curtain is less than 100 mm.

10. The curtain applicator according to claim 1, wherein said at least one blocking device comprises at least two air nozzles, each for generating a respective air shield, wherein one of said two air nozzles is provided ahead of the curtain and one air nozzle is provided behind the curtain, and wherein a flow direction of the air of said at least two air shields has in each case a component which points toward the material web.

11. A method for applying a liquid or pasty application medium to a surface of a running material web, the method comprising:

providing a curtain applicator with an applicator nozzle and dispensing, under the effect of gravity a single-tier or multi-tier curtain from the applicator nozzle onto the surface of the material web;

keeping entrained air that is carried by the running material web away from the curtain by way of a wiping device in a vicinity of the running material web upstream of a location at which the curtain dispensed by the applicator nozzle impinges on the running material web;

providing at least one blocking device that is structurally different from the wiping device and that is disposed ahead of and/or behind the curtain in a running direction of the material web, the at least one blocking device having one or a plurality of nozzles for generating an air shield; and keeping air flows of ambient air away from the curtain by way of the at least one blocking device by generating at least one air shield with the one or plurality of air nozzles with a flow direction of air in the air shield having a component that points away from the material web and the air shield being formed upstream of the wiping device and reaching upwardly beyond a height of the wiping device.

12. The method according to claim 11, which comprises applying the application medium with the applicator nozzle at a flow rate of less than 10 l/min*m.

13. The method according to claim 12, which comprises applying the application medium with the applicator nozzle at a flow rate between 2 l/min*m and 5 l/min*m.

14. The method according to claim 13, which comprises moving the material web at a speed between 100 m/min and 800 m/min.

15. The method according to claim 14, which comprises moving the material web at a speed between 200 m/min and 600 m/min.

16. The method according to claim 11, wherein the application medium has a solids content between 55% and 75%.

17. The method according to claim 11, wherein a Brookfield viscosity of the application medium at 100 rpm is between 100 mPas and 800 mPas.

* * * * *